US011969852B2

(12) United States Patent
Nairz

(10) Patent No.: US 11,969,852 B2
(45) Date of Patent: Apr. 30, 2024

(54) GRINDING TOOL FOR GRINDING AN ENGINE BLOCK

(71) Applicant: Tyrolit—Schleifmittelwerke Swarovski K.G., Schwaz (AT)

(72) Inventor: Mario Nairz, Vomp (AT)

(73) Assignee: Tyrolit—Schleifmittelwerke Swarovski AG & Co K.G., Schwaz (AT)

( * ) Notice: Subject to any disclaimer, the term of this patent is extended or adjusted under 35 U.S.C. 154(b) by 1196 days.

(21) Appl. No.: 16/274,489

(22) Filed: Feb. 13, 2019

(65) Prior Publication Data

US 2019/0275631 A1 Sep. 12, 2019

(30) Foreign Application Priority Data

Mar. 12, 2018 (AT) ..... A 50211/2018

(51) Int. Cl.
*B24B 55/02* (2006.01)
*B24B 5/36* (2006.01)
(Continued)

(52) U.S. Cl.
CPC ..... *B24B 33/02* (2013.01); *B24B 5/36* (2013.01); *B24B 23/02* (2013.01); *B24B 55/02* (2013.01); *B24D 5/10* (2013.01); *B24D 7/10* (2013.01)

(58) Field of Classification Search
CPC ..... B24B 55/02; B24B 45/00; B24B 5/10; B24B 7/10; B24B 33/02; B24B 5/36; B24B 23/02; B24D 5/10; B24D 7/10
(Continued)

(56) References Cited

U.S. PATENT DOCUMENTS 2,410,812 A * 11/1946 De Michel ..... B24D 9/08 451/511
3,606,710 A 9/1971 Juillerat
(Continued)

FOREIGN PATENT DOCUMENTS

CN 1878636 12/2006
CN 101111341 1/2008
(Continued)

OTHER PUBLICATIONS

Austrian Search Report dated Nov. 16, 2018 in corresponding Austrian Patent Application No. A 50211/2018 with English translation.

*Primary Examiner* — Brian D Keller
*Assistant Examiner* — Marcel T Dion
(74) *Attorney, Agent, or Firm* — Wenderoth, Lind & Ponack, L.L.P.

(57) ABSTRACT

A grinding tool for grinding an engine includes a main body with a central coupling region for connecting to a rotary drive of a grinding machine, the main body having a substantially rotationally symmetrical configuration with respect to an axis of rotation. The grinding tool also includes a grinding layer on the main body that extends over an outer circular ring zone of the main body, at least one feed for a cooling fluid, and a substantially circular cover plate arranged substantially normal to the axis of rotation and forming an axial gap on the main body. The axial gap is in fluid communication with the feed and the grinding layer so that a cooling fluid fed by the feed can be passed via the axial gap to the grinding layer.

27 Claims, 5 Drawing Sheets

(51) Int. Cl.

| | |
|---|---|
| ***B24B 23/02*** | (2006.01) |
| ***B24B 33/02*** | (2006.01) |
| ***B24D 5/10*** | (2006.01) |
| ***B24D 7/10*** | (2006.01) |

(58) Field of Classification Search
USPC ..... 451/178, 259, 449, 450, 451, 548, 488
See application file for complete search history.

(56) References Cited

U.S. PATENT DOCUMENTS

| | | | | |
|---|---|---|---|---|
| 3,754,359 | A * | 8/1973 | Scandaletos | B24D 7/10 451/449 |
| 4,411,107 | A * | 10/1983 | Sekiya | B24D 18/0018 451/450 |
| 4,854,087 | A | 8/1989 | Riha | |
| 5,423,717 | A * | 6/1995 | Boaz | B24B 9/10 451/449 |
| 5,846,125 | A * | 12/1998 | Robichon | B24D 5/10 451/550 |
| 5,993,297 | A * | 11/1999 | Hyatt | B24D 7/16 451/450 |
| 6,358,133 | B1 * | 3/2002 | Cesena | B24D 18/00 451/542 |
| 6,966,826 | B2 | 11/2005 | Suzuki et al. | |
| 7,235,007 | B2 | 6/2007 | Junker | |
| 7,377,839 | B2 * | 5/2008 | Schrottner | B24D 5/10 451/450 |
| 7,384,329 | B2 | 6/2008 | Rutkiewicz et al. | |
| 7,393,268 | B2 | 7/2008 | Schrottner | |
| 8,171,608 | B2 | 5/2012 | Kammermeier et al. | |
| 10,137,549 | B2 * | 11/2018 | Koik | B23Q 11/1046 |
| 2003/0032382 | A1 | 2/2003 | Suzuki et al. | |
| 2007/0082592 | A1 * | 4/2007 | Junker | B24D 5/066 451/541 |
| 2007/0259610 | A1 | 11/2007 | Schrottner | |
| 2007/0275636 | A1 * | 11/2007 | Rutkiewicz | B24D 7/10 451/7 |
| 2008/0310929 | A1 | 12/2008 | Kammermeier et al. | |
| 2013/0260655 | A1 * | 10/2013 | Michiyoshi | B24D 5/02 451/488 |
| 2014/0329448 | A1 * | 11/2014 | Song | B24D 5/10 451/488 |
| 2015/0246428 | A1 * | 9/2015 | Koechl | B24D 7/02 51/298 |
| 2018/0071892 | A1 * | 3/2018 | Jung | B23Q 11/1076 |

FOREIGN PATENT DOCUMENTS

| | | |
|---|---|---|
| CN | 102166731 | 8/2011 |
| CN | 102294637 | 12/2011 |
| DE | 544374 | 2/1932 |
| DE | 101 49 712 | 1/2003 |
| DE | 10 2008 025 120 | 3/2009 |
| EP | 1 859 904 | 11/2007 |
| EP | 1 982 796 | 10/2008 |
| JP | 2009-208215 | 9/2009 |
| RU | 2 228 832 | 5/2004 |
| SU | 901039 | 1/1982 |
| WO | 2005/023490 | 3/2005 |

* cited by examiner

GRINDING TOOL FOR GRINDING AN ENGINE BLOCK

The present invention concerns a grinding tool for grinding an engine block, including a main body including a central coupling region for connecting the main body to a rotary drive of a grinding machine, wherein the main body is of a substantially rotationally symmetrical configuration with respect to an axis of rotation, a grinding layer which is arranged on the main body and extends at least over an outer circular ring zone of the main body, at least one feed for a cooling fluid, and a substantially circular cover plate which is arranged substantially normal to the axis of rotation and forming an axial gap on the main body, wherein the axial gap is in fluid communication with the at least one feed and the grinding layer so that a cooling fluid fed by way of the at least one feed can be passed by way of the axial gap to the grinding layer. The invention further concerns an arrangement comprising such a grinding tool and a hollow shank taper (HSK) holder connected thereto at least by way of the central coupling region of the main body.

Grinding tools for grinding engine blocks are already known per se from the state of the art. The grinding process used in that case is also referred to as 'micro milling' or 'smear grinding'. In the course of the grinding process the material subjected to the grinding process is removed and 'smeared' over the microporosity of the surface to be ground.

The grinding tools are frequently cooled by means of a cooling fluid, in which case a cooling fluid fed by way of a feed means is passed to the grinding layer by way of an axial gap. In that case the cover plate is positioned at a spacing relative to the main body, whereby this provides a cylindrical gap between the cover plate and the main body, by way of which the cooling fluid is distributed.

In recent times there has been a need for optimisation in regard to the service life of a grinding tool which is cooled in that way and the surface finish of the surface of the engine blocks, that is to be machined with the grinding tool.

The object of the invention is therefore to improve the service life of the grinding tool and the surface finish of the surface of the engine blocks, that is to be machined with the grinding tool, in comparison with the state of the art, and to provide an arrangement comprising a grinding tool which is improved in that way and an HSK holder connected thereto at least by way of the central coupling region of the main body.

It is therefore provided according to the invention in the grinding tool that first passages for specifically passing the cooling fluid from the at least one feed to the grinding layer are arranged at a surface of the main body, that faces towards the cover plate, and/or at a surface of the cover plate, that faces towards the main body.

The cooling fluid can thus be guided specifically and in targeted fashion by way of first passages from the at least one feed to the grinding layer, thereby permitting more uniform and more controlled distribution of the cooling fluid. In addition material which has been ground off can be removed more efficiently. Overall this results in a service life which is greater by about 30% than the state of the art.

Overall that leads to a surface finish which is improved in comparison with the state of the art, for the surface of the engine blocks, that is to be machined with the grinding tool. In more specific terms the surface has fewer scratches, better material contact area values (also in recent times called material proportion in specialist circles) and better or greater evenness.

In the grinding tool according to the invention, as in the state of the art, the cover plate can be arranged at a spacing relative to the main body so that, in addition to the first passages, a cylindrical gap is arranged between the cover plate and the main body. In a preferred embodiment however it is provided that the surface of the main body, that faces towards the cover plate, and the surface of the cover plate, that faces towards the main body are in region-wise contact with each other. In that case there is no cylindrical gap between the cover plate and the main body, but a plurality of axial gaps which have the geometry of the first passages.

As stated in the opening part of this specification protection is also sought for an arrangement comprising a grinding tool according to the invention and an HSK holder connected thereto at least by way of the first coupling region of the main body.

In that respect it is appropriate for the cooling fluid to be fed to the grinding tool through a central opening extending in the axial direction in the HSK holder.

BRIEF DESCRIPTION OF THE DRAWINGS

Further details and advantages of the present invention are discussed more fully hereinafter by means of the specific description with reference to the Figures in which.

DETAILED DESCRIPTION OF THE INVENTION

Figure 1:
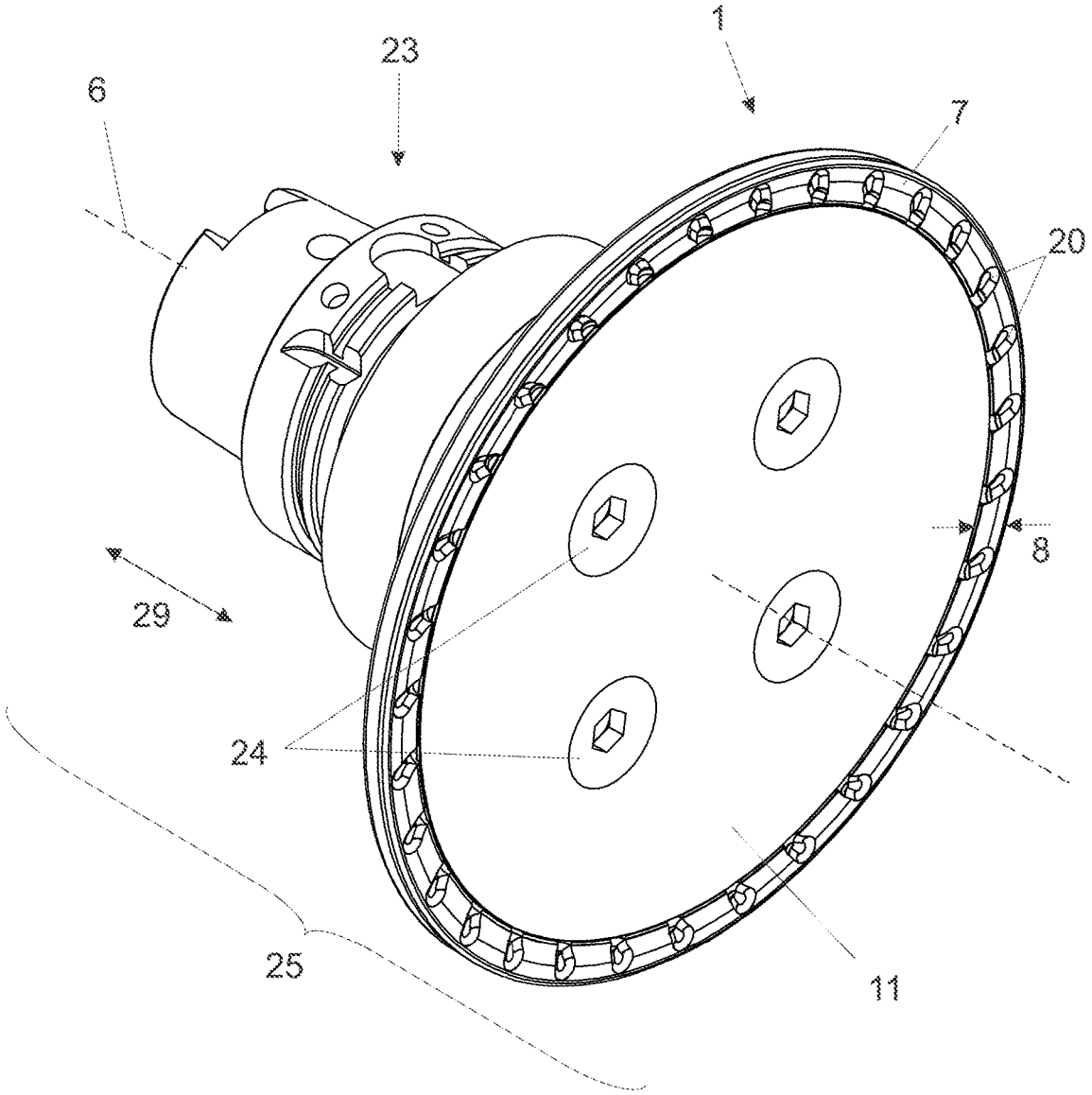
FIG. 1 shows a diagrammatic perspective view of an arrangement comprising a grinding tool according to a preferred embodiment by way of example and an HSK holder.
Figure 2:
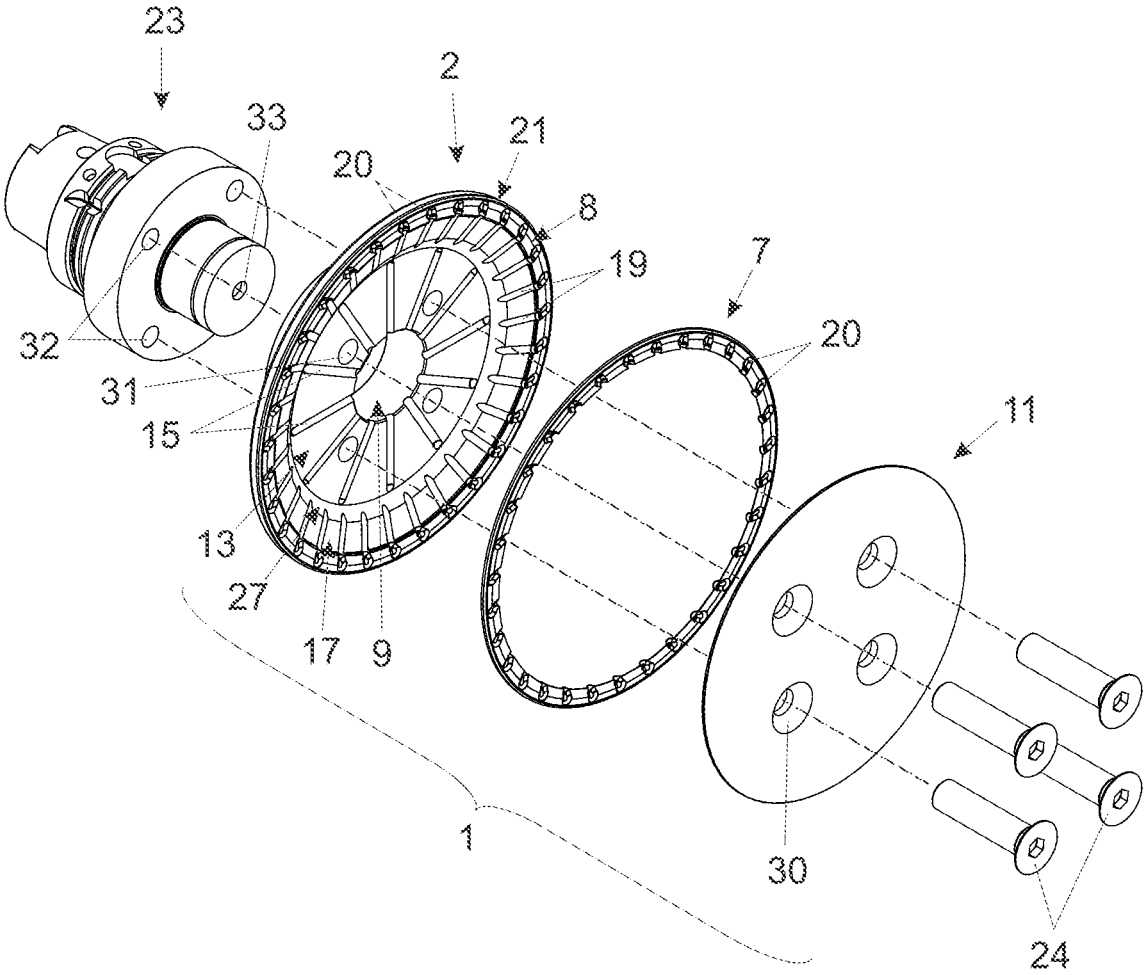
FIG. 2 shows an exploded view of the arrangement of FIG. 1.
Figure 3A:
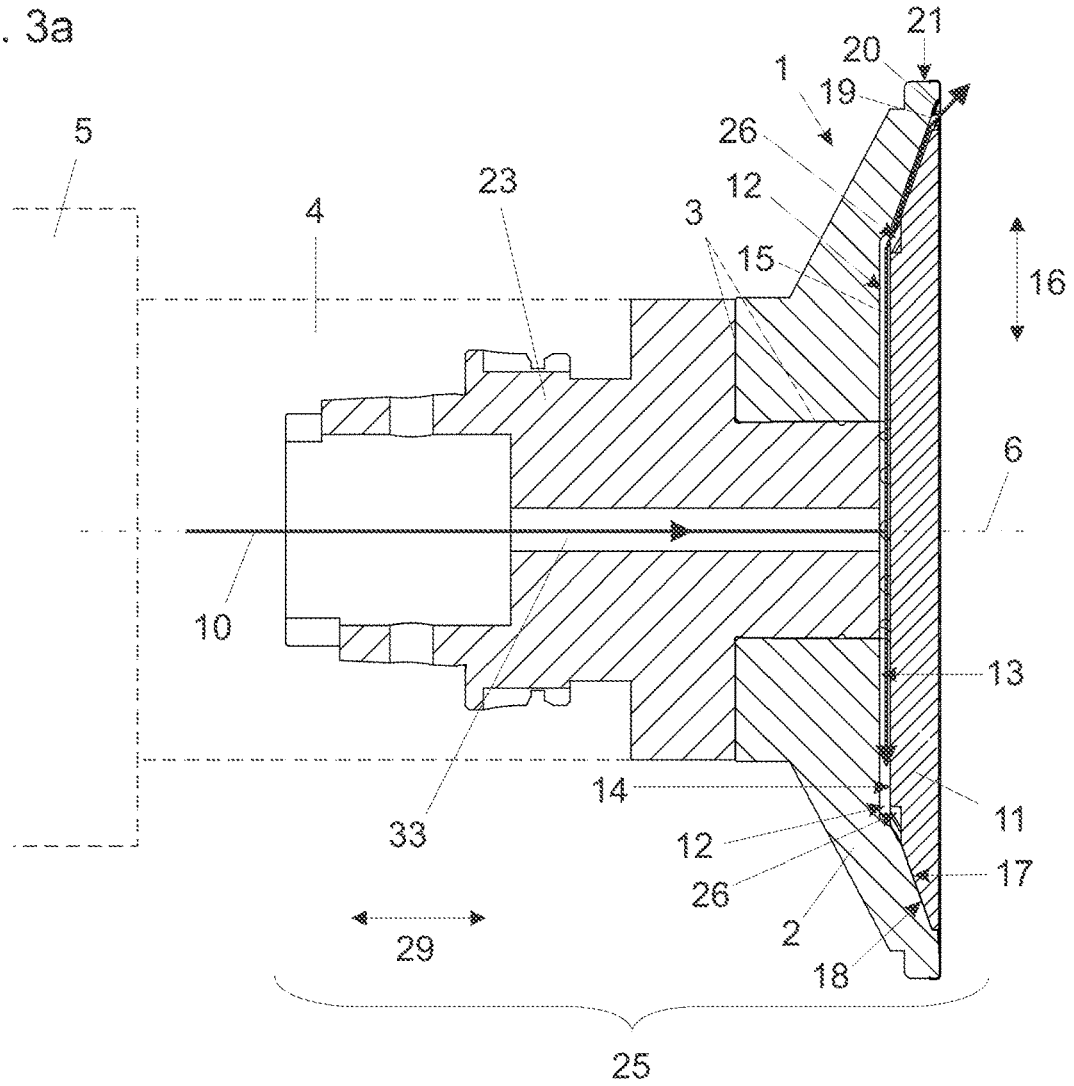
FIG. 3*a* shows a diagrammatic cross-sectional view of the arrangement of FIG. 1 together with an indicated rotary drive of a grinding machine.
Figure 3B:
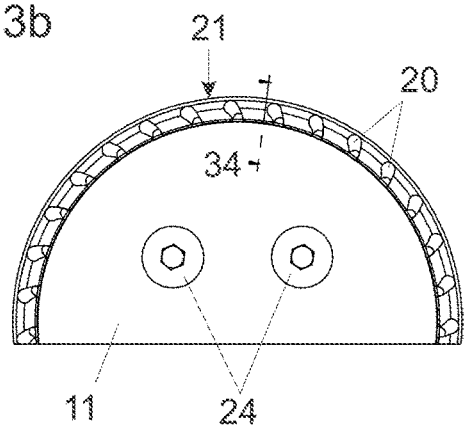
FIG. 3*b* shows a plan view from the front of a portion of the grinding tool of FIG. 1.

FIGS. 1, 2 and 3*a* show an arrangement 25 comprising a grinding tool 1 for grinding an engine block and a hollow shank taper (HSK) holder 23. The grinding tool 1 includes a main body 2 including a central coupling region 3 for connecting the main body 2 to a rotary drive 4 of a grinding machine 5 (indicated in broken lines in FIG. 3*a*), wherein the main body 2 is of a substantially rotationally symmetrical configuration with respect to an axis of rotation 6. The central coupling region 3 is of such a configuration that the grinding tool 1 can be connected to an HSK holder 23.

The grinding tool 1 further includes a grinding layer 7 extending at least over an outer circular ring zone 8 of the main body 2, at least one feed 9 for a cooling fluid 10 and a substantially circular cover plate 11 arranged substantially normal to the axis of rotation 6 and forming an axial gap 12 at the main body 2, wherein the axial gap 12 is in fluid communication with the at least one feed 9 and the grinding layer 7 so that a cooling fluid 10 fed by way of the at least one feed 9 can be guided by way of the axial gap 12 to the grinding layer 7 (see FIG. 3*a*).

The circular ring zone 8 of the main body 2 is oriented substantially normal to the axis of rotation 6.

First passages 15 for specifically targetedly guiding the cooling fluid 10 from the at least one feed 9 to the grinding layer 7 are arranged at a surface 13 of the main body 2, that faces towards the cover plate 11.

According to an alternative embodiment it can also be provided that first passages 15 for specifically targetedly guiding the cooling fluid 10 from the at least one feed 9 to the grinding layer 7 are arranged at a surface 14 of the cover plate 11, that faces towards the main body 2.

According to a further alternative embodiment it can also be provided that first passages 15 for specifically targetedly guiding the cooling fluid 10 from the at least one feed 9 to the grinding layer 7 are arranged both at the surface 13 of the main body 2, that faces towards the cover plate 11, and also at the surface 14 of the cover plate 11, that faces towards the main body 2.

The feed 9 for the cooling fluid 10 extends substantially parallel to the axis of rotation 6 or in the axial direction 29 and is in the form of a bore in the main body 2. That feed 9 can also continue in the HSK holder 23 in the form of an opening 33.

The cover plate 11, the main body 2 and the HSK holder 23 are releasably connected together by way of connecting means 24 in the form of screws. The screws pass through openings 30 in the cover plate 11 and openings 31 in the main body 2 and are mounted in bores 32 in the HSK holder 23. The screws 24 can have a male thread and the bores 32 can have a corresponding female thread.

In an alternative configuration it can be provided that on the one hand the cover plate 11 is connected to the main body 2 and on the other hand the assembly of the cover plate 11 and the main body 2 is connected to the HSK holder 23.

The surface 13 of the main body 2, that faces towards the cover plate 11, and the surface 14 of the cover plate 11, that faces towards the main body 2, are in region-wise contact with each other, more specifically at the locations at which there are no first passages 15.

The main body 2 and the cover plate 11 each have a respective inclined surface 17, 18 adjoining the grinding layer 7, wherein the inclined surfaces 17, 18 are in region-wise contact with each other.

Second passages 19 for specifically targetedly guiding the cooling fluid 10 are arranged at the inclined surface 17. Alternatively second passages 19 for specifically targetedly guiding the cooling fluid 10 can also be arranged at the inclined surface 18 or at both inclined surfaces 17 and 18.

Third passages 20 for specifically guiding the cooling fluid 10 are arranged in the circular ring zone 8 of the main body 2 or at the grinding layer 7, the third passages 20 being connected to the second passages 19.

An annular passage 26 for specifically guiding the cooling fluid 10 is arranged between the main body 2 and the cover plate 11.

As can be seen in particular from FIG. 3*a* a cooling fluid 10 which is fed in the axial direction 29 is passed by way of the first passages 15 radially in the direction of the outer rim 21 of the main body 2, passes into the annular passage 26, from there into the second passages 19 and finally into the third passages 20 which are arranged in the grinding layer 7.

Figure 3C:
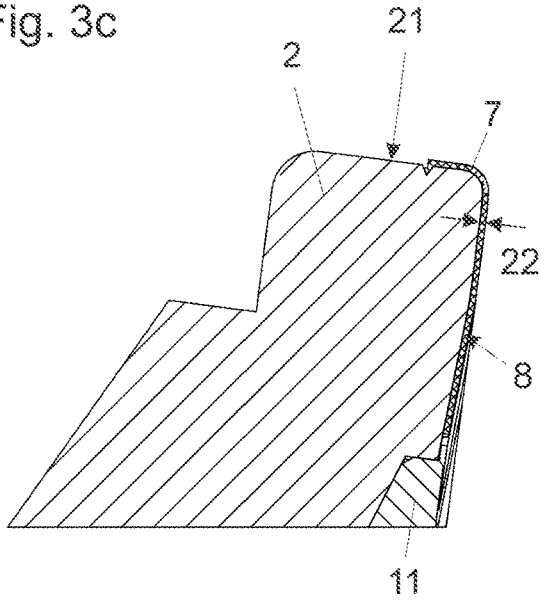
FIG. 3*c* shows a diagrammatic cross-sectional view of the grinding tool along the section plane 34 shown in FIG. 3*b*.

FIG. 3*c* shows the outer circular ring zone 8 of the main body 2 in detail. The grinding layer 7 arranged in that circular ring zone 8 on the main body 2 includes diamonds, is galvanically connected to the main body 2, and is of a thickness 22 of between 0.1 mm and 1 mm, preferably about 0.3 mm. In addition it can be seen that the grinding layer 7 is not only oriented substantially normal to the axis of rotation 6, but also surrounds a part of the outer rim 21 of the main body 2.

Figure 4A:
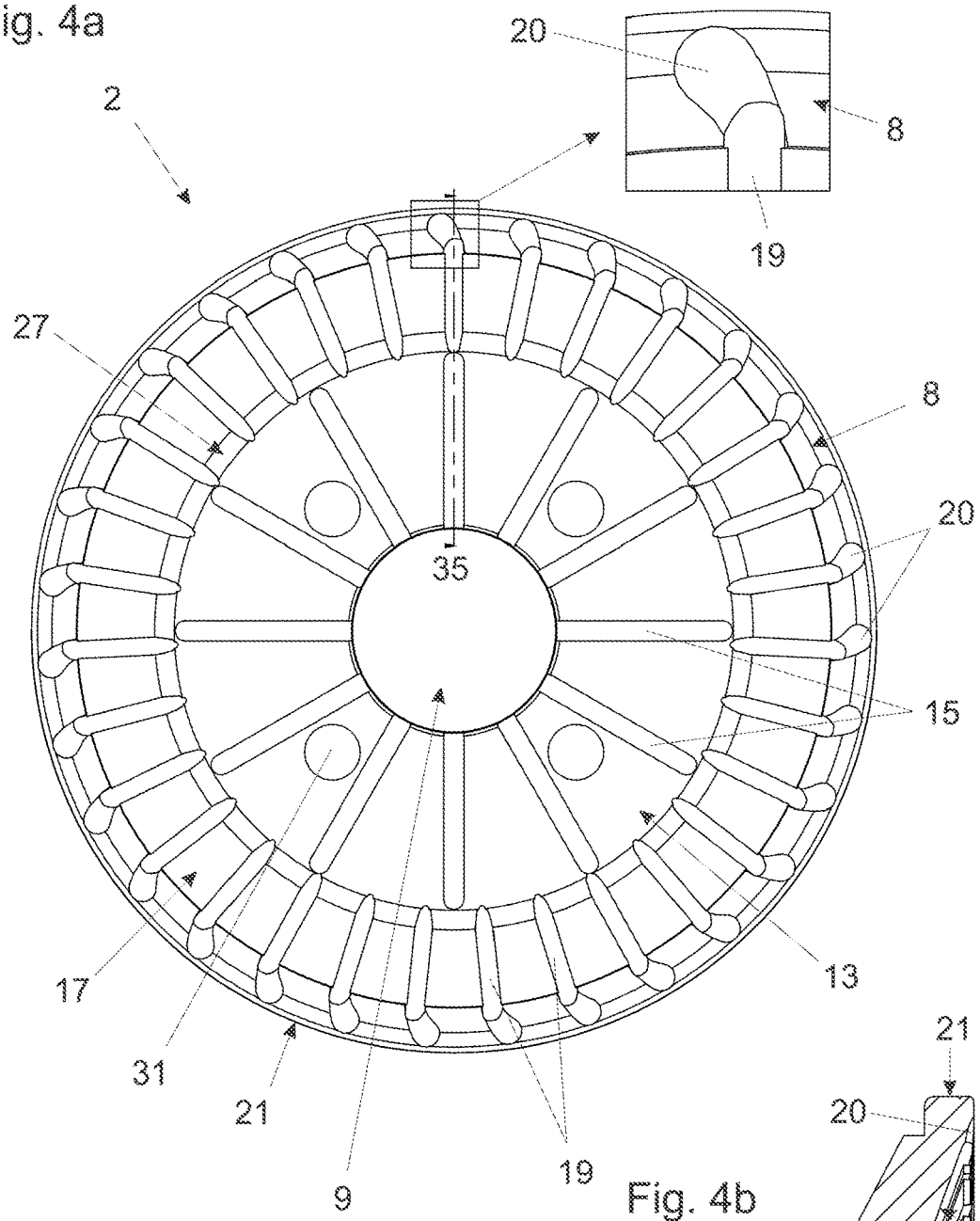
FIG. 4*a* shows a plan view from the front of the main body of the grinding tool of FIG. 1.
Figure 4B:
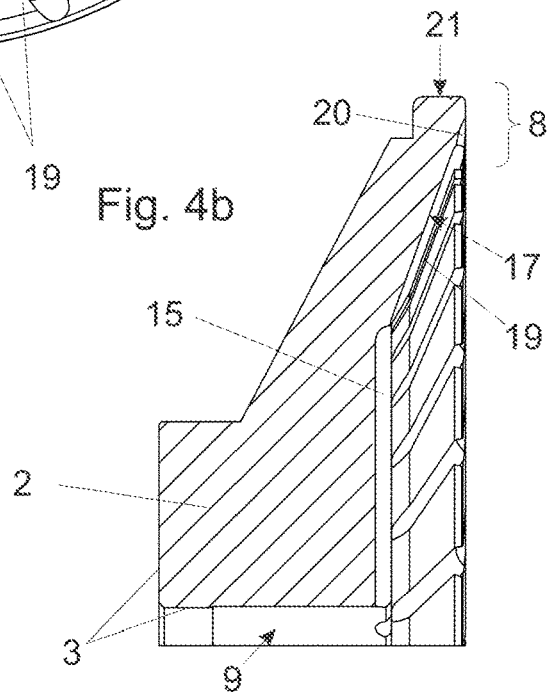
FIG. 4*b* shows a diagrammatic cross-sectional view of the main body along the section plane 35 shown in FIG. 4*a*.

Details of the cooling fluid distribution system can be seen from FIGS. 4*a* and 4*b*.

The first passages 15, starting from the feed 9, extend outwardly in a star shape substantially in the radial direction 16. The passages 15 are each at the same angular spacing relative to each other.

Figure 5:
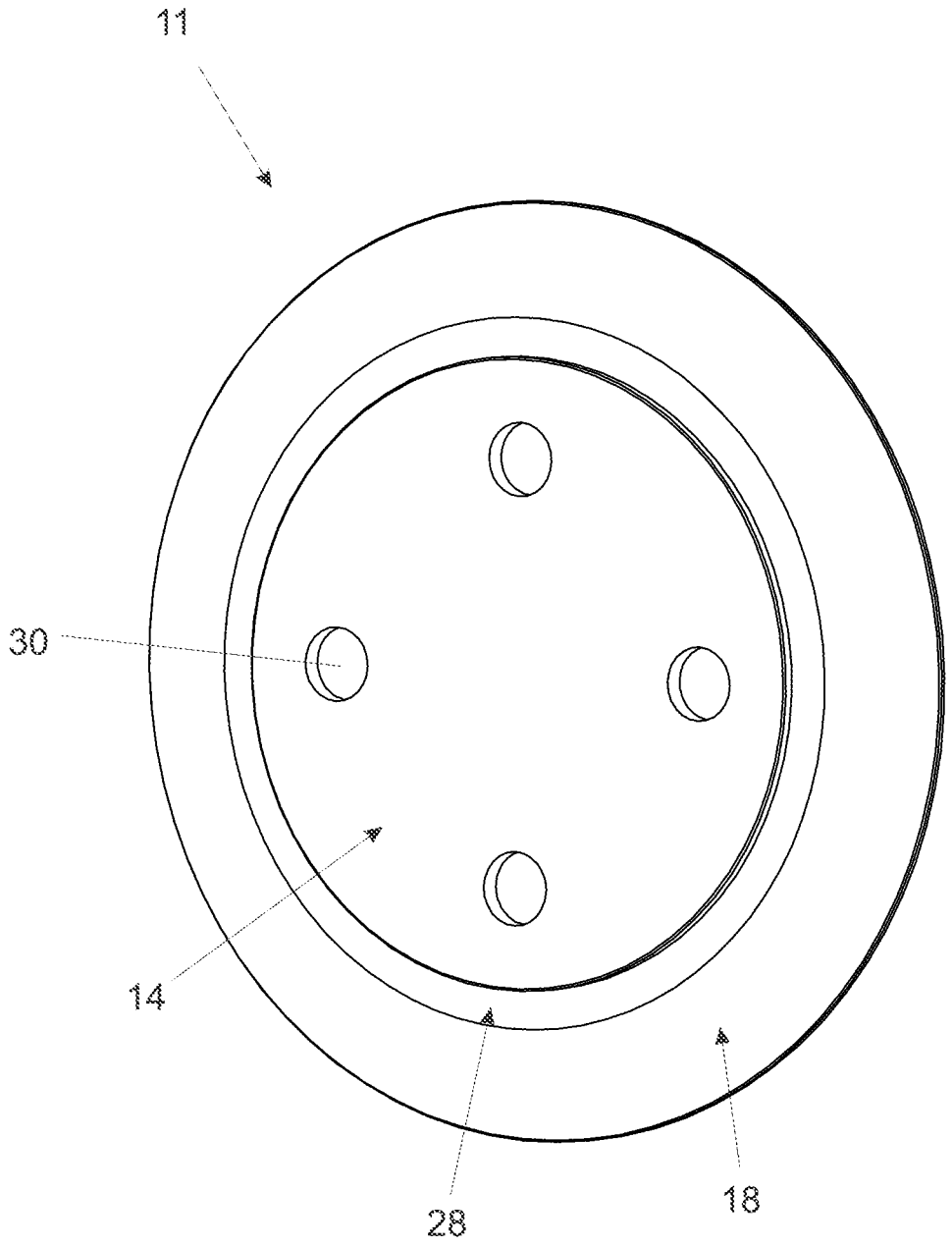
FIG. 5 shows a diagrammatic perspective view from the rear of the cover plate of the grinding tool of FIG. 1.

The first passages 15 open into the annular passage 26 and the annular passage 26 is provided by a hollow space between a surface portion 27 arranged on the main body 2 and a surface portion 28 on the cover plate 11 (see also FIG. 5).

Starting from the annular passage 26 the cooling fluid 10 passes into the second passages 19. They are arranged in a displaced relationship with the first passages 15. There are more second passages 19 than first passages 15. The second passages 19 also extend outwardly in the radial direction.

From the second passages 19 the cooling fluid 10 passes into the third passages 20 which are connected to the second passages 19. There are precisely as many third passages 20 as second passages 19. The third passages 20 extend inclinedly with respect to the radial direction 16 and widen towards the outer rim 21 of the main body 2.

FIG. 5 shows the cover plate 11 of the grinding tool 1 from the rear. It is possible to see the surface 14 that faces towards the main body 2, the surface portion 28 which together with the surface portion 27 of the main body 2 delimits the annular passage 26 in the axial direction 29, and the inclined surface 18. In the illustrated embodiment no passages for specifically guiding the cooling fluid 10 are arranged at the surface 14 and the inclined surface 18. In an alternative embodiment it is possible to provide passages here in addition to or instead of the passages 15 and 19 provided on the main body 2.

The invention claimed is:

1. A grinding tool for grinding an engine block, comprising:

a main body including a central coupling region for connecting the main body to a rotary drive of a grinding machine, wherein the main body is of a substantially rotationally symmetrical configuration with respect to an axis of rotation;

a grinding layer which is arranged on the main body and extends at least over an outer circular ring zone of the main body;

at least one feed for a cooling fluid; and a substantially circular cover plate which is arranged substantially normal to the axis of rotation and forming an axial gap on the main body, wherein the axial gap is in fluid communication with the at least one feed and the grinding layer so that a cooling fluid fed by way of the at least one feed can be passed by way of the axial gap to the grinding layer, wherein a first surface of the main body and a second surface of the cover plate face each other in opposite axial directions, and first passages for specifically passing the cooling fluid from the at least one feed to the grinding layer are arranged at the first surface of the main body or at the second surface of the cover plate, the first passages being arranged in a plane parallel to the first surface of the main body, wherein a majority of the grinding layer extends along an axially front surface of the main body, wherein an annular passage for specifically guiding the cooling fluid is arranged between the main body and the cover plate, the annular passage being connected to outlets of the first passages, wherein second passages for specifically guiding the cooling fluid are arranged radially outward of the first passages and are connected to the annular passage, and wherein third passages for specifically guiding the cooling fluid are directly connected to the second passages, respectively, and wherein outlets of the third passages are formed on the axially front surface of the main body.

2. The grinding tool as set forth in claim 1, wherein the first surface of the main body and the second surface of the cover plate are in contact with each other in areas between adjacent ones of the first passages.

3. The grinding tool as set forth in claim 2, wherein the first passages extend substantially in a radial direction.

4. The grinding tool as set forth in claim 3, wherein at least one of the main body and the cover plate has an inclined surface which adjoins the grinding layer.

5. The grinding tool as set forth in claim 4, wherein each of the main body and the cover plate has an inclined surface which adjoins the grinding layer, and wherein portions of the inclined surfaces are in contact with each other.

6. The grinding tool as set forth in claim 2, wherein at least one of the main body and the cover plate has an inclined surface which adjoins the grinding layer.

7. The grinding tool as set forth in claim 6, wherein each of the main body and the cover plate has an inclined surface which adjoins the grinding layer, and wherein portions of the inclined surfaces are in contact with each other.

8. The grinding tool as set forth in claim 6, wherein the second passages for specifically guiding the cooling fluid are arranged at the inclined surface.

9. The grinding tool as set forth in claim 1, wherein the first passages extend substantially in a radial direction.

10. The grinding tool as set forth in claim 9, wherein at least one of the main body and the cover plate has an inclined surface which adjoins the grinding layer.

11. The grinding tool as set forth in claim 10, wherein each of the main body and the cover plate has an inclined surface which adjoins the grinding layer, and wherein portions of the inclined surfaces are in contact with each other.

12. The grinding tool as set forth in claim 1, wherein at least one of the main body and the cover plate has an inclined surface which adjoins the grinding layer.

13. The grinding tool as set forth in claim 12, wherein the second passages for specifically guiding the cooling fluid are arranged at the inclined surface.

14. The grinding tool as set forth in claim 13, wherein the second passages are arranged so as to be circumferentially displaced relative to the first passages, or more second passages are provided than first passages.

15. The grinding tool as set forth in claim 13, wherein there are provided precisely as many third passages as second passages.

16. The grinding tool as set forth in claim 12, wherein each of the main body and the cover plate has an inclined surface which adjoins the grinding layer, and wherein portions of the inclined surfaces are in contact with each other.

17. The grinding tool as set forth in claim 1, wherein the third passages for specifically guiding the cooling fluid are arranged in the circular ring zone of the main body.

18. The grinding tool as set forth in claim 17, wherein the third passages extend inclinedly with respect to the radial direction, or widen towards an outer rim of the main body.

19. The grinding tool as set forth in claim 1, wherein the outlets of the first passages open into the annular passage, or the annular passage is provided by a hollow space between a surface portion arranged on the main body and a surface portion arranged on the cover plate.

20. The grinding tool as set forth in claim 1, wherein the at least one feed for the cooling fluid extends substantially parallel to the axis of rotation, or is in the form of a bore in the main body.

21. The grinding tool as set forth in claim 1, wherein the circular ring zone of the main body is oriented substantially normal to the axis of rotation.

22. The grinding tool as set forth in claim 1, wherein the grinding layer includes diamonds, is arranged directly on the main body, is galvanically connected to the main body, or has a thickness of between 0.1 mm and 1 mm.

23. The grinding tool as set forth in claim 22, wherein the grinding layer has a thickness of about 0.3 mm.

24. The grinding tool as set forth in claim 1, wherein the central coupling region includes an annular portion configured such that the grinding tool can be connected to a hollow shank taper (HSK) holder, or the cover plate and the main body are releasably connected together by way of connecting means.

25. The grinding tool as set forth in claim 24, wherein the cover plate, the main body and an HSK holder are releasably connected together by way of screws as the connecting means.

26. An arrangement comprising the grinding tool as set forth in claim 1, and a hollow shank taper (HSK) holder connected thereto at least by way of the central coupling region of the main body.

27. A grinding tool for grinding an engine block, comprising:

a main body including a central coupling region for connecting the main body to a rotary drive of a grinding machine, wherein the main body is of a substantially rotationally symmetrical configuration with respect to an axis of rotation;

a grinding layer which is arranged on the main body and extends at least over an outer circular ring zone of the main body;

at least one feed for a cooling fluid; and a substantially circular cover plate which is arranged substantially normal to the axis of rotation and forming an axial gap on the main body, wherein the axial gap is in fluid communication with the at least one feed and the grinding layer so that a cooling fluid fed by way of the at least one feed can be passed by way of the axial gap to the grinding layer, wherein a first surface of the main body and a second surface of the cover plate face each other in opposite axial directions, and first passages for specifically passing the cooling fluid from the at least one feed to the grinding layer are arranged at the first surface of the main body or at the second surface of the cover plate, the first passages being arranged in a plane parallel to the first surface of the main body, wherein a majority of the grinding layer extends along an axially front surface of the main body, wherein each of the main body and the cover plate has an inclined surface which is inclined relative to the axis of rotation and which adjoins the grinding layer, and portions of the inclined surfaces are in direct contact with each other, and wherein second passages are formed by grooves in at least one of the inclined surfaces.

* * * * *